US010288342B2

(12) United States Patent
Ding et al.

(10) Patent No.: US 10,288,342 B2
(45) **Date of Patent: *May 14, 2019**

(54) REFRIGERATOR DOOR WITH A HANDLE GROOVE

(71) Applicant: BSH HAUSGERAETE GMBH, Munich (DE)

(72) Inventors: Yuan Ding, Wuxi (CN); Jicong Song, Nanjing (CN); Changliang Zhao, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/325,621

(22) PCT Filed: Jul. 17, 2015

(86) PCT No.: PCT/IB2015/055423
§ 371 (c)(1),
(2) Date: Jan. 11, 2017

(87) PCT Pub. No.: WO2016/009396
PCT Pub. Date: Jan. 21, 2016

(65) Prior Publication Data

US 2017/0146281 A1 May 25, 2017

(30) Foreign Application Priority Data

Jul. 18, 2014 (CN) ..... 2014 1 0346243
Jul. 28, 2014 (CN) ..... 2014 1 0363195

(51) Int. Cl.
*F25D 23/02* (2006.01)
*E05B 1/04* (2006.01)

(52) U.S. Cl.
CPC ..... *F25D 23/028* (2013.01); *E05B 1/04* (2013.01); *E05Y 2900/31* (2013.01); *F25D 2323/021* (2013.01); *F25D 2400/361* (2013.01)

(58) Field of Classification Search
CPC ..... F25D 23/02; F25D 23/028; F25D 29/00; F25D 29/005; F25D 2323/02; F25D 2400/361
See application file for complete search history.

(56) References Cited

U.S. PATENT DOCUMENTS 2,567,565 A * 9/1951 Keeler ..... E05B 1/04 16/110.1
3,648,411 A * 3/1972 Saunders ..... E05B 1/0015 16/412

(Continued)

FOREIGN PATENT DOCUMENTS

CN 201803554 U * 4/2011 ..... F25D 23/02
DE 102011007318 A1 * 10/2012 ..... F25D 23/028

(Continued)

OTHER PUBLICATIONS

JP2013178054 Translated Description, 8 pages.*
JP2004044980 Translated Description, 7 pages.*
DE102012200812 Translated Description, 13 pages.*

*Primary Examiner* — Andrew M Roersma
(74) *Attorney, Agent, or Firm* — Laurence A. Greenberg; Werner H. Stemer; Ralph E. Locher

(57) ABSTRACT

A refrigerator includes a door having a door liner, a front wall, a user interface housing connected to the front wall, a user interface electrical module and a handle. The user interface housing, the door liner and the front wall are fixedly connected to a heat insulating layer. The user interface housing has first and second receiving spaces which can be in communication. The user interface electrical module can be inserted into the first receiving space through the (Continued)

second receiving space. The handle is detachably received in the second receiving space and separates the first receiving space from a handle groove in the second receiving space. The user interface housing has at least one installation wall between the first receiving space and the handle groove in a depth direction of the handle groove, and the handle is fixed to the installation wall.

17 Claims, 6 Drawing Sheets

(56) References Cited

U.S. PATENT DOCUMENTS 3,766,598 A * 10/1973 Roberts ..... A47B 95/02 16/444
3,995,349 A * 12/1976 Roberts ..... A47B 95/02 16/412
5,704,093 A * 1/1998 Trulaske, Sr. ..... A47B 95/02 16/443
8,485,617 B2 * 7/2013 Park ..... F25D 23/028 312/405.1
8,523,304 B2 * 9/2013 Kim ..... F25D 29/005 312/405.1
8,567,885 B2 * 10/2013 Lee ..... E05D 7/0027 312/405
8,752,919 B2 * 6/2014 Park ..... F25D 23/028 312/405.1
9,459,041 B2 * 10/2016 Park ..... F25D 23/028
2013/0125345 A1 * 5/2013 Specht ..... E05B 1/0015 16/413
2014/0208657 A1 * 7/2014 Kim ..... F25D 23/02 49/460
2015/0192353 A1 * 7/2015 Lee ..... F25D 23/028 312/325
2016/0003519 A1 * 1/2016 Kim ..... F25D 29/005 362/307
2017/0115049 A1 * 4/2017 Ding ..... F25D 23/028
2017/0138658 A1 * 5/2017 Ding ..... F25D 23/028
2017/0146281 A1 * 5/2017 Ding ..... F25D 23/028
2017/0159994 A1 * 6/2017 Ding ..... F25D 23/028
2017/0176091 A1 * 6/2017 Becke ..... F25D 23/028
2017/0184336 A1 * 6/2017 Becke ..... F25D 23/028
2017/0191737 A1 * 7/2017 Becke ..... F25D 23/028

FOREIGN PATENT DOCUMENTS

DE 102012200810 A1 * 7/2013 ..... F25D 23/028
DE 102012200812 A1 7/2013
EP 2264387 A2 * 12/2010 ..... F25D 23/028
EP 2405216 A1 * 1/2012 ..... F25D 23/028
EP 2859814 A1 * 4/2015 ..... A47B 95/02
JP 2004044980 A 2/2004
JP WO 2010100925 A1 * 9/2010 ..... F25D 23/028
JP 2013178054 A 9/2013
JP WO 2014034433 A1 * 3/2014 ..... F25D 29/005
WO WO 2007060188 A2 * 5/2007 ..... F24C 7/082
WO WO 2009080494 A1 * 7/2009 ..... F25D 23/02
WO WO-2011018268 A1 * 2/2011 ..... F25D 23/02

* cited by examiner

REFRIGERATOR DOOR WITH A HANDLE GROOVE

BACKGROUND

Technical Field

The present invention relates to a refrigerator, and more particularly to a refrigerator having a handle groove on a door.

Related Art

JP 2013-178054 A discloses a refrigerator door, including a door body having a heat insulating layer. A user interface apparatus is disposed in an intermediate region, viewed from a longitudinal direction, of the door body, and located behind a glass plate of the door body. A step member making a front surface recessed is formed on a side cover of a right end portion of the door body. The step member closes and receives a receiving chamber of the user interface apparatus. A handle protruding towards the right side is installed on an installation surface of a side facing the step member by using a screw. A handle groove extending along the whole height of the door is formed between the handle and the step member. A front surface of the handle portion is covered by a protective cover clamped between a front end of the handle portion and the step member. The protective cover is formed by a transparent resin formed part.

SUMMARY

One objective of the present invention is to overcome at least one technical problem in the prior art, so as to provide an improved refrigerator.

The objective can be achieved through features in the independent claim. Preferred embodiments of the present invention are subject matters of the accompanying drawings, the specification and the dependent claims.

One aspect of the present invention relates to a refrigerator. The refrigerator includes a door, characterized in that, the door includes a door liner, a front wall, and a user interface housing connected to the front wall, wherein the user interface housing, the door liner and the front wall are fixedly connected to a heat insulating layer, and the user interface housing has a first receiving space and a second receiving space; a user interface electrical module received in the first receiving space, wherein the user interface electrical module can enter into the first receiving space via the second receiving space; and a handle detachably received in the second receiving space and separating the first receiving space from a handle groove in the second receiving space, the handle including a grip portion located in the second receiving space; wherein the user interface housing has at least one installation wall, the installation wall is located between the first receiving space and the handle groove in a depth direction of the handle groove, and the handle is fixed to the installation wall.

On the one hand, the handle closes the first receiving space which receives the user interface module, and thus it is unnecessary to use another member to close the first receiving space; on the other hand, the handle and the handle groove are located in the second receiving space in the user interface housing, it is likely that a handle function and a user interface function form an integrated operation center, and viewed from the front of the door, it is also possible that the handle and the user interface housing are blocked by the same front panel. Further, as the user interface housing has an installation wall and the installation wall is located behind the handle groove, it is likely that a fixing apparatus between the handle and the user interface housing is set as not seen by the user or not particularly obviously seen by the user, for example, it is likely that only a part of the fixing apparatus is located deep in the handle groove.

The present invention is applicable to refrigerators with various different structures, for example, the present invention is applicable to a side-by-side combination refrigerator having a first storage chamber and a second storage chamber distributed side by side, is applicable to a refrigerator having a first storage chamber and a second storage chamber distributed up and down, and may have a refrigerator where a pair of doors close the same storage chamber.

A storage chamber of a refrigerator may be used for storing food and/or wine, for example, the refrigerator may have at least one storage chamber purely for storing wine.

The door may be a rotatable door pivotally connected to the main body of the refrigerator, and may also be a drawer-type door drawably connected to the main body.

The door may close one or more storage chambers of the refrigerator, and may also close a part of one or more storage chambers.

In one possible embodiment, the handle groove may be disposed close to a longitudinal side of the door. In one alternative embodiment, the handle groove is disposed close to a horizontal side portion of the door, for example, the top or the bottom.

The user interface electrical module may include an input unit for receiving a user input instruction and/or an output unit displaying information for a user.

The front wall is located in front of the door liner. In one possible embodiment, the front wall forms at least most of the front surface, that is, the front wall is exposed outside. In another possible embodiment, the door may further include a decorative board located in front of the front wall. Such a decorative board may be made of, for example, a glass or glasslike material. In one possible embodiment, the front wall may also be made of a glass or glasslike material.

In one possible embodiment, the front wall is formed by a single member, for example, the front wall may be formed by a metal sheet. In another possible embodiment, the front wall may also be formed by multiple members, and the members may form corresponding parts of the front wall with the whole or a part thereof.

The user interface electrical module may be completely located in the first receiving space, or one part is located in the first receiving space, and the other part is located outside the first receiving space.

The handle groove is located in the second receiving space, and a part of its boundary may be formed by the user interface housing.

The so-called "the handle is detachably" means detaching the handle from the door by using a tool or not using a tool without damaging the door, where the handle can be installed to the door once again. When the handle is detached, the user interface module may be taken out of the first receiving space or placed into the first receiving space.

Other individual features or those combined with other features to be regarded as characteristics of the present utility model are set forth in the following appended claims.

In one possible embodiment, the door may include a fixing member for fixing the handle to the user interface housing, and the fixing member passes through a through hole in the handle and is connected to the installation wall.

In one possible embodiment, the fixing member passes through the handle and the installation wall along a depth direction of the handle groove.

In one possible embodiment, the handle may have a cover portion for separating the first receiving space and the handle groove, and the cover portion is fixed to the installation wall. This not only facilitates reliable fixing of the handle, but also can hide the fixing member deep into the handle groove not easily seen by the user as the handle is fixed to the user interface housing through the cover portion.

In one possible embodiment, the cover portion may be at least substantially perpendicular to a front surface of the door.

In one possible embodiment, the user interface housing may include a support portion supporting a front portion of one side of the cover portion which side is away from the handle groove. So, a tendency may not occur that the cover portion and the grip portion rotate around a certain region of one side of the cover portion facing the first receiving space when the user grips the grip portion to open the door, which not only helps to reliably fix the handle onto the door, but also helps to prevent a situation from occurring where the grip portion moves to butt the front panel forward to cause poor contact between the front panel and the user interface housing. In one possible embodiment, the user interface housing is supporting one side of the cover portion, which side is away from the handle groove, along a whole width of the cover portion.

A stop portion may directly butt against the cover portion to stop the cover portion, and may also butt against another member (e.g., seal) connected to the handle to stop the cover portion.

In one possible embodiment, the support portion may be formed by a part of the installation wall. A front end of the installation wall is supported at a front portion of one side of the cover portion away from the handle groove. For example, the installation wall may have a width at least substantially the same as that of the cover portion, and the installation wall butts against the cover portion on the whole width of the cover portion. Thus, that the user interface housing is supported at a front portion of one side of the cover portion facing the installation wall can be achieved without increasing additional construction, thereby preventing that the handle tends to turn over.

In one possible embodiment, the user interface housing may include at least one pair of installation walls, and the pair of installation walls are located on one corresponding side of an inlet of the first receiving space. So, the installation walls will not affect insertion or removal of the user interface electrical module into or from the first receiving space.

In one possible embodiment, the user interface housing may include a boss adjacent to the first receiving space, and the installation wall is formed by the boss. This, on the one hand, may increase strength of the installation wall, and on the other hand, the user interface housing pulls forward at the boss, which helps to increase the thickness of the heat insulating layer located at a rear side of the boss, thus enhancing heat insulating effects of the door. In one alternative embodiment, the installation wall is formed by a wall independent of the boss.

In one possible embodiment, the user interface housing may include a plurality of protruding walls protruding forward from the bosses, and the protruding walls form a support portion supporting a front portion of one side of the cover portion which side faces the installation wall.

In one possible embodiment, the front wall may have an opening, the user interface housing is connected to the front wall along the opening, the first receiving space and the second receiving space are open towards the opening, and the bosses are exposed to the opening. By disposing bosses in the user interface housing, whether the user interface electrical module and the handle have the same length, the user interface housing can have a shape and size independent of the user interface electrical module, as long as at least one part of the boundary of the first receiving space is formed by using the bosses located on the user interface housing, so that it is possible that the opening of the front wall and the user interface housing have a relatively flat shape, for example, the opening of the front wall is rectangular, to facilitate manufacturing and assembling between the user interface housing and the front wall.

In one possible embodiment, the door may include a front panel covering the user interface electrical module and the grip portion.

In one possible embodiment, the user interface electrical module may be connected with the front panel, a gap is formed between a front surface of the grip portion and the front panel, and the gap is not less than 0.2 mm and not greater than 1 mm, especially between 0.2 mm and 0.6 mm. Therefore, a front surface of the grip portion is disposed adjacent to the front panel. In this way, not only can foreign matter's entry into the gap be reduced, but also the probability may be greatly reduced that the front panel and the user interface electrical module are in poor contact possibly caused by a force applied to the front panel by the grip portion when the grip portion is gripped to pull the door forward.

In one possible embodiment, the second receiving space may include a concave portion open forward, and the handle groove is accessible via the concave portion. By integrating the concave portion in the user interface housing, the concave portion is formed without an additional member, which not only helps to simplify construction of the door, but also helps to form an integrated user operation center.

In one possible embodiment, the handle may include a metal reinforcer for at least reinforcing the grip portion. This particularly helps to solve the technical problem that the front panel and the user interface electrical module are in poor contact possibly caused by a force applied to the front panel by deformation of the handle, especially the grip portion in a direction perpendicular to the direction where the hand is inserted into the handle groove. As the metal reinforcer can significantly reduce deformation of the grip portion, it is possible that the front panel and the grip portion maintain a tiny distance therebetween and even are in direct contact.

In one embodiment, the reinforcer is received in one receiving space of the handle. In one possible embodiment, the reinforcer is integrally injection-molded with the handle as inserts.

In one possible embodiment, the reinforcer may extend along substantially the whole length of the grip portion.

In one possible embodiment, the door may include a seal, and the seal includes a sealing portion disposed along at least one side of the cover portion. The sealing portion may be located between the front panel and the handle, between the first rear wall and the handle, and/or between upper and lower end walls and the handle, so that possibility can be reduced that water vapor, dust and the like enter into the first receiving space to reduce the service life of electric parts.

The structure and other invention objectives as well as beneficial effects of the present invention will be more comprehensible with reference to the accompanying drawings and the description about the preferred embodiments.

BRIEF DESCRIPTION OF THE DRAWINGS

As a part of the specification and for facilitating further comprehension of the present invention, the following accompanying drawings illustrate specific implementation manners of the present invention, and describe the principle of the present invention together with the specification.

DETAILED DESCRIPTION

Figure 1:
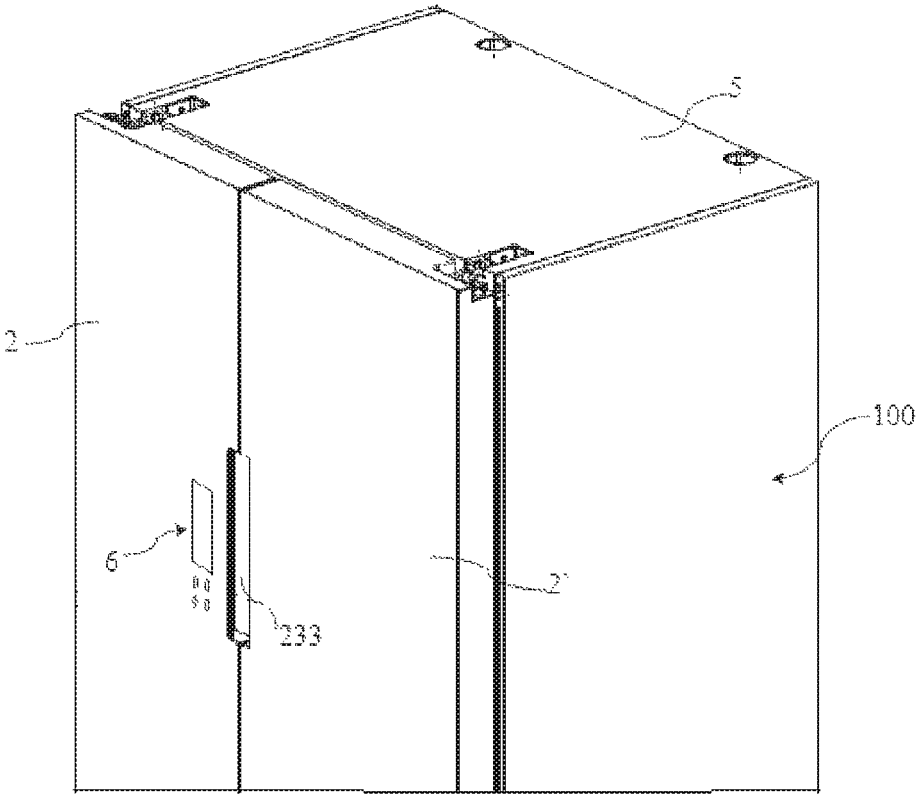
FIG. 1 is a schematic partial perspective view of a refrigerator according to one preferred embodiment of the present invention.

FIG. 1 is a schematic perspective view of a refrigerator 100 according to one preferred embodiment of the present invention. As shown in FIG. 1, the refrigerator 100 includes a main body 5 having a first storage chamber (not shown) and a second storage chamber (not shown) disposed side by side. The refrigerator 100 further includes a pair of oppositely-opened doors 2, 2' connected to the main body 5 to respectively close the corresponding storage chambers.

Figure 2:
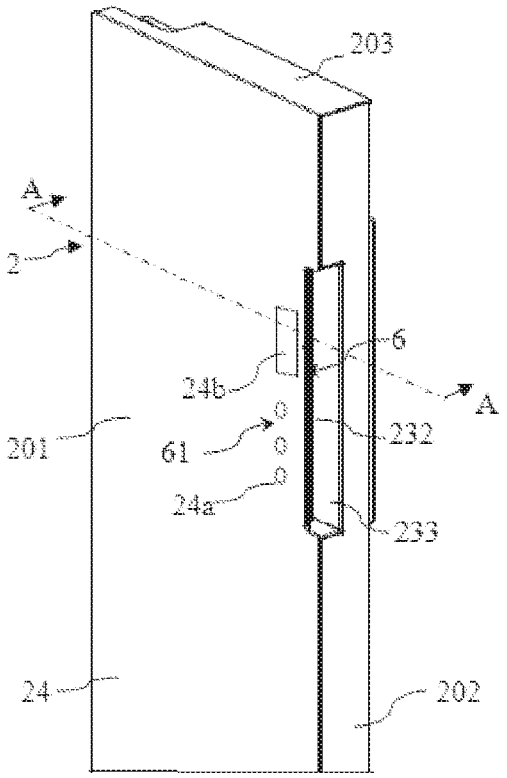
FIG. 2 is a schematic partial perspective view of a door according to one preferred embodiment of the present invention.
Figure 3:
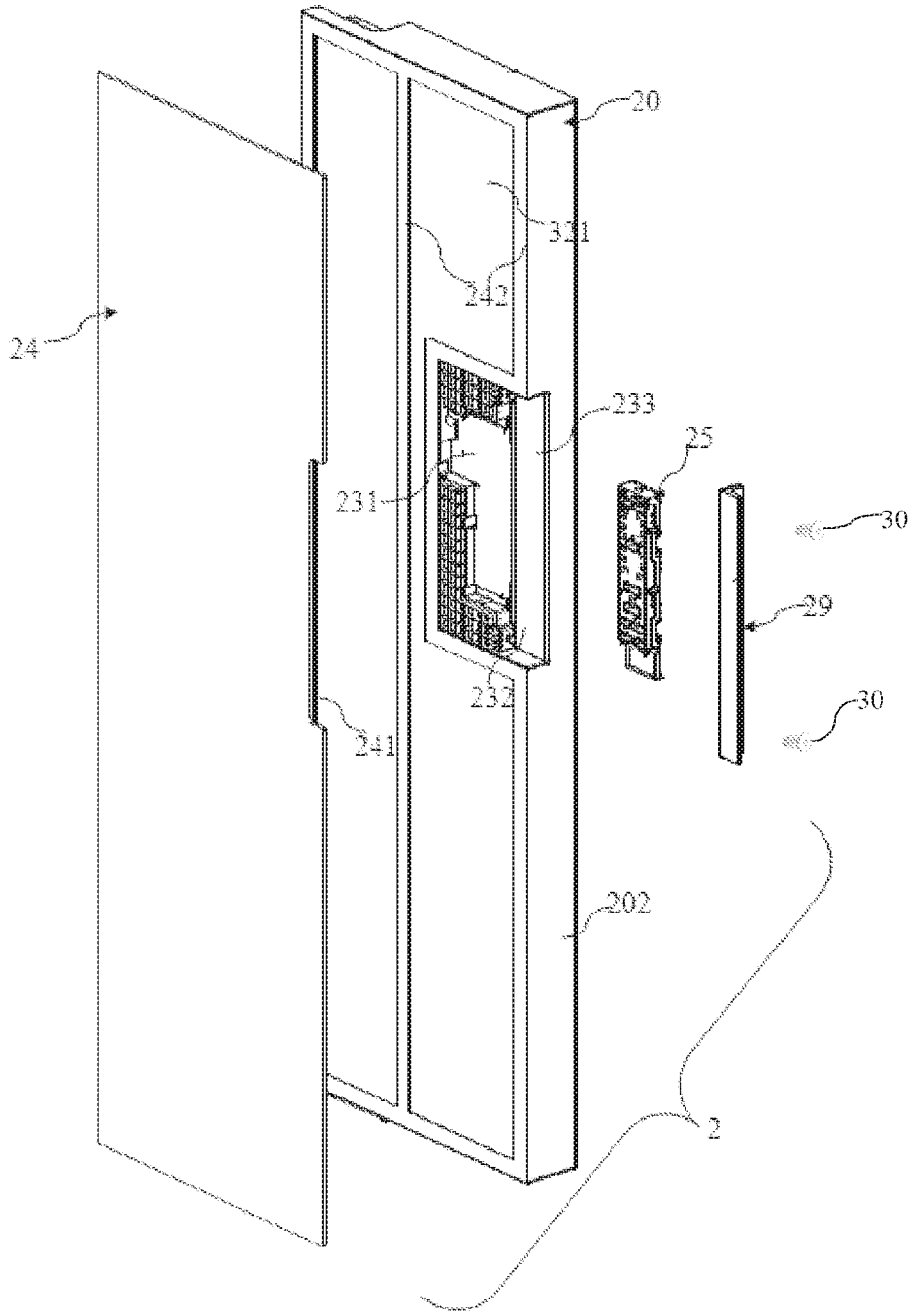
FIG. 3 is a partial exploded view of a door according to one preferred embodiment of the present invention.
Figure 7:
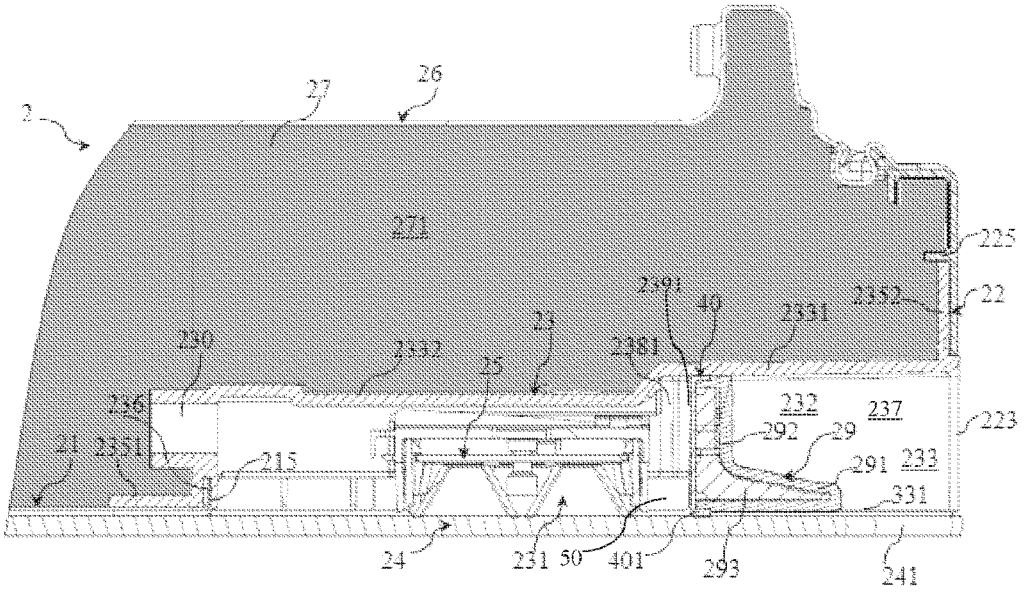
FIG. 7 is a partial sectional view along the A-A line in FIG. 2.

Referring to FIG. 2, FIG. 3 and FIG. 7 in combination with FIG. 1, the door 2 has an integrated operation center 6. The operation center 6 includes a user interface 61 and a handle groove 232 integrated into the operation center 6. When opening or closing the door 2, the user's hand can extend into the handle groove 232. The operation center 6 further includes a concave portion 233, and the user's hand enters into the handle groove 232 through the concave portion 233.

The concave portion 233 extends along part of the length of the door 2, and is at a distance from a top surface 203 and a bottom surface (not shown) of the door 2.

The user interface 61 is disposed to be used for receiving input and output information of the user, and the information, for example, includes setting information about the refrigerator 100 and/or information of food stored in the refrigerator 100, etc. The user interface 61 includes a plurality of touch regions 24*a* and a display region 24*b* (merely shown in FIG. 1) formed on the front panel 24. The touch regions 24*a* can, as shown in FIG. 2, be separated from the display region 24*b*, and can also be located in the display region 24*b*. The user interface 61 includes a user interface electrical module 25 located behind the touch regions 24*a* and the display region 24*b*. The user interface electrical module 25 includes a light source, and when the light source is opened, light can transmit through the display region 24*b*.

As shown in FIG. 7, the concave portion 233 is open towards a front surface 201 and a side surface 202 of the door 2. The concave portion 233, the handle groove 232 and the user interface electrical module 25 are arranged side by side in a depth direction (which is also a transverse direction of the door 2 in this embodiment) of the handle groove 232. Viewed from the front, visual elements of the user interface 61, for example, the touch regions 24*a* and the light-transmitting display region 24*b*, the handle groove 232 and the concave portion 233 are disposed side by side in sequence in a transverse direction of the door 2.

The door 2 includes a door body 20 having a heat insulating layer 27, and the front panel 24 covers the front of the door body 20 of the handle. The front panel 24 has an edge notch 241 located in front of the concave portion 233, so as to expose the concave portion 233 to the front.

The front panel 24 may be made from glass or appearance glass resin. The front panel 24 may be bonded to the door body 20 through a bonding apparatus 242 disposed at least around a front edge of the door body 20.

Figure 4:
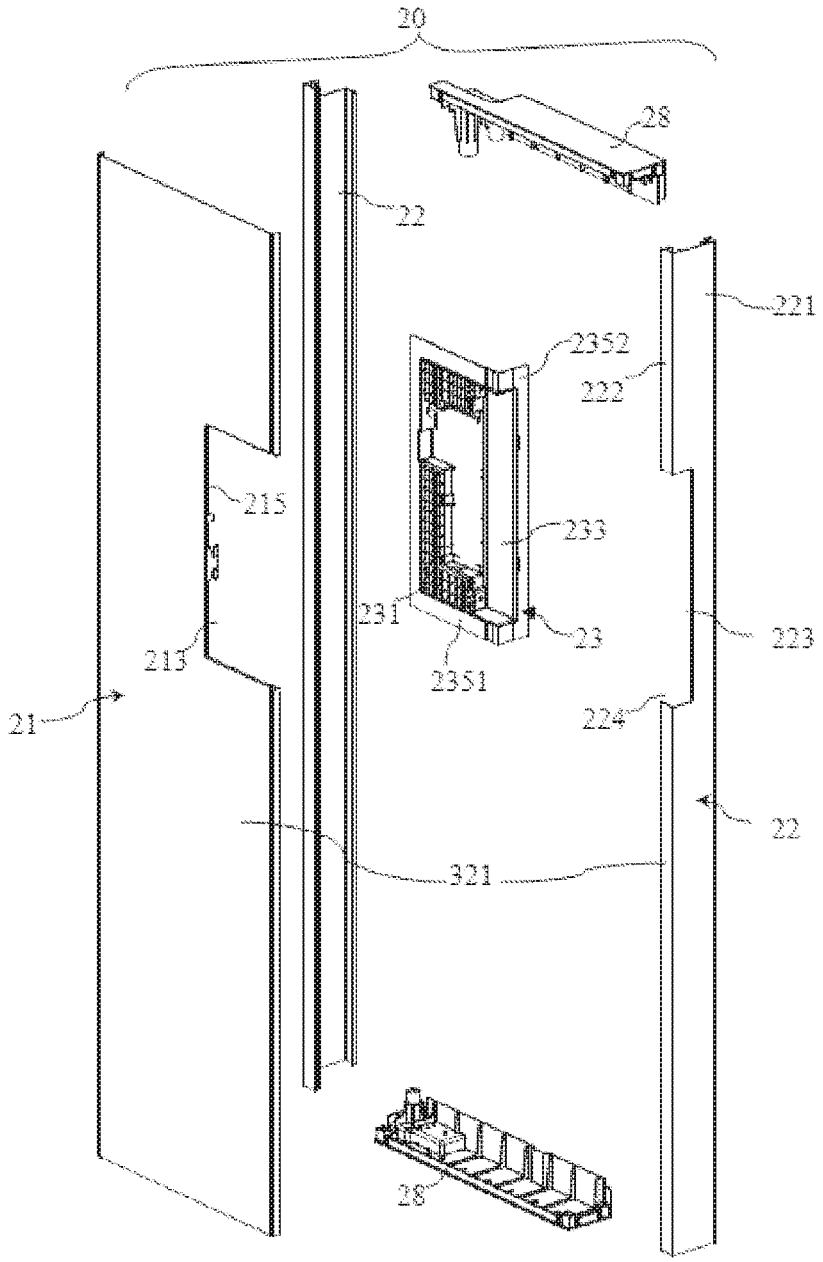
FIG. 4 is a partial exploded view of a door body according to one preferred embodiment of the present invention.

Referring to FIG. 4 and FIG. 7, the door body 20 includes a metal sheet 21, a pair of door rims 22 connected to one corresponding longitudinal side of the metal sheet 21, upper and lower end handles 28 respectively connected to an upper end and a lower end of the metal sheet 21 and a user interface housing 23 connected to the metal sheet 21 and a corresponding door rim 22. The heat insulating layer 27 is filled into a heat insulating space 271 encircled by the metal sheet 21, the door rims 22, the end handles 28, the user interface housing 23 and a door liner 26.

In this embodiment, each door rim 22 has a side wall 221 forming a main portion thereof and a front strip 222 connected to a front end of the side wall 221 and extending inwards.

The metal sheet 21 is connected to the door rims 22 to make the front strip 222 and the metal sheet 21 together form a front wall 321 of the door body 20 located in front of the liner 26. Each front strip 222 is located on one corresponding side of the metal sheet 21.

The front wall 321 has a first opening 331 (shown in FIG. 7), and the first opening 331 is formed by a first edge opening 213 located on the metal sheet 21 and a second edge opening 224 located on the right door rim 22.

The side wall 221 has a second opening 223, and the first opening 331 and the second opening 223 are in communication at a connecting angle between the front wall 321 and the side wall 221.

The user interface housing 23 is connected to the front wall 321 and the side wall 221 to close the first opening 331 and the second opening 223 relative to the heat insulating space 271, that is, the heat insulating space 271 can be closed at the first opening 331 and the second opening 223 due to the user interface housing 23. An inner surface of the user interface housing 23 is towards the heat insulating space 271, so, after a foaming procedure of the door 2, the user interface housing 23 is fixedly connected to the heat insulating layer 27 filled into the heat insulating space 271.

Figure 5:
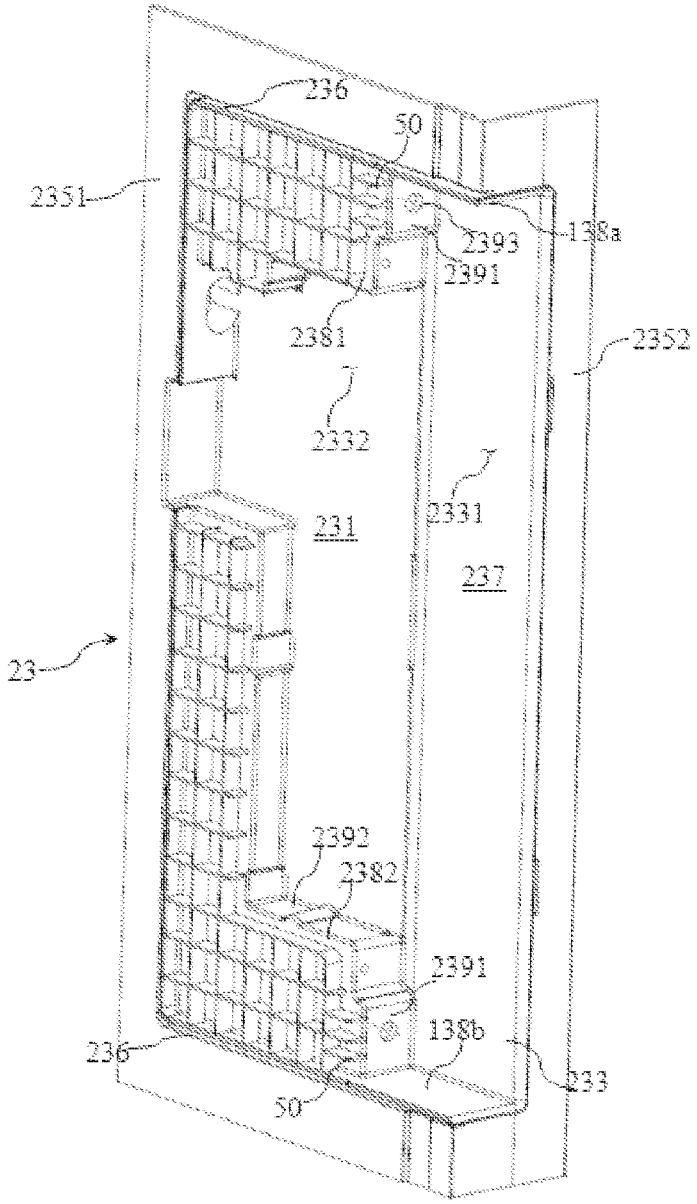
FIG. 5 is a schematic perspective view of a user interface housing according to one preferred embodiment of the present invention.

Referring to FIG. 5 and FIG. 7 in combination with FIG. 4, the user interface housing 23 includes a first connecting flange 2351 for connecting a rear surface of the front wall 321 and a second connecting flange 2352 connected with an inner surface of the side wall 221. The first connecting flange 2351 and the second connecting flange 2352 are connected with each other and perpendicular to each other.

The first connecting flange 2351 and the second connecting flange 2352 respectively include three connecting strips, and the connecting strips are distributed along corresponding edges of the first opening 331 and the second opening 223.

The user interface housing 23 has a connecting slot 236 located on an inner side of the first connecting flange 2351. The metal sheet 21 has a turnup 215 disposed along the first edge opening 213. The turnup 215 is inserted into the connecting slot 236 to position the user interface housing 23 and the metal sheet 21 before a foaming procedure of the door body 20.

As shown in FIG. 7, the door rim 22 includes a protruding portion 225 protruding inwards from the side wall 221, and an end of the second connecting flange 2352 abuts against the protruding portion 225. So the user interface housing 23 can be extruded forward, which facilitates in-place connection of the turnup 215 and the connecting slot 236, and also helps to prevent a foaming agent from leaking from the heat insulating space 271. It can be expected that it is unnecessary to use an additional foaming leakage measure between the protruding portion 225 and the second connecting flange 2352.

The user interface housing 23 has a first receiving space 231 for receiving the user interface electrical module 25. The first receiving space 231 is open towards the first opening 331, so that the user interface electrical module 25 may be in contact with the front panel 24 located in front of the first receiving space 231, to receive an instruction input by the user by touching the front panel 24.

The user interface housing 23 includes a second receiving space 237 for forming the handle groove 232 and the concave portion 233. The first receiving space 231 and the second receiving space 237 are distributed side by side in a transverse direction of the door 2.

The handle groove 232 and the concave portion 233 are distributed left and right side by side in the second receiving space 237, and they are one part of the second receiving space 237 respectively.

The first receiving space 231, the handle groove 232 and the concave portion 233 are located in the user interface housing 23. The concave portion 233, the handle groove 232 and the first receiving space 231 are sequentially disposed side by side along a depth direction of the handle groove 232.

The user interface housing 23 includes a first rear wall 2331 located at the back of the handle groove 232 and the concave portion 233 and a second rear wall 2332 corresponding to the first receiving space 231. The first rear wall 2331 and the second rear wall 2332 are disposed side by side and a front surface thereof faces the front panel 24. Rear sides of the first rear wall 2331 and the second rear wall 2332 are fixedly connected to the heat insulating layer 27.

The first rear wall 2331 and the second rear wall 2332 may have a step therebetween. Specifically, a distance between the first rear wall 2331 and the front panel 24 forming the front surface 201 of the door 2 is greater than that between the second rear wall 2332 and the front panel 24, as shown in FIG. 7.

The user interface housing 23 includes a plurality of bosses 2381 and 2382 adjacent to the first receiving space 231. The bosses 2381 and 2382 protrude towards the front panel 24. The bosses 2381 and 2382 are exposed to the first opening 331.

In a longitudinal direction, the bosses 2381 and 2382 are at least partially located between the upper end wall 138*a* and the first receiving space 231 or between the lower end wall 138*b* and the first receiving space 231, so that the first receiving space 231 has a length less than that of the handle groove 232 and the concave portion 233.

The bosses 2381 and 2382 include a pair of first boss walls 2391 connected with the first rear wall 2331 and extending forward perpendicular to the first rear wall 2331.

The bosses 2381 and 2382 further include a pair of second boss walls 2392 facing the first receiving space 231. The second boss walls 2392 extend forward from the second rear wall 2332. The second boss walls 2392 form upper and lower boundaries of the first receiving space 231.

The first rear wall 2331 extends to and connects the side surface 202 of the door 2, thus forming a rear boundary of the concave portion 233. That is to say, the rear boundaries of the concave portion 233 and the handle groove 232 are defined by the common first rear wall 2331. The second receiving space 237 has continuous rear boundaries.

In this embodiment, the front surface of the first rear wall 2331 is basically flat, and is basically parallel to the front surface 201 of the door 2.

The first receiving space 231 has an opening open towards the second receiving space 237. The opening is closed by a handle 29 detachably connected to the door body 20.

The handle 29 is detachably received in the second receiving space 237 and separates the first receiving space 231 from a handle groove 232 in the second receiving space 237.

Specifically, when the handle 29 is detached from the door 2, one side of the first receiving space 231 open towards the door 2 to be capable of receiving the user interface electrical module 25 or taking out the user interface electrical module 25 therefrom. Specifically, the user interface electrical module can be inserted into the first receiving space 231 or taken out from the first receiving space 231 through the handle groove 232. When the handle 29 is fixed to the door 2, a side opening of the first receiving space 231 is closed, so that the user's hand cannot extend into the first receiving space 231.

The user interface housing 23 may also have a through-line hole 230 for threading a cable (not shown).

The handle 29 includes a grip portion 291 located in the second receiving space 237 and located in front of the handle groove 232. The grip portion 291 forms a front boundary of the handle groove 232, and when the user's hand extends into the handle groove 232, the user's fingers extending into the handle groove 232 can grip the grip portion 291, to open the door 2. Generally, some fingers of the user are pressed on a rear surface of the grip portion 291, and another finger (e.g., thumb) is pressed on the front panel 24 located in front of the grip portion 291, so as to apply a force to open the door 2.

The handle 29 includes a cover portion 292 for closing the open side of the first receiving space 231. The grip portion 291 is connected to a front side of the cover portion 292, and a rear side of the grip portion 291 is opposite the first rear wall 2331 of the user interface housing 23. That is, the first rear wall 2331 of the user interface housing 23 facing the handle groove 232 forms a rear boundary of the handle groove 232.

The cover portion 292 separates the handle groove 232 and the first receiving space 231. One side of the cover portion 292 towards the handle groove 232 can be at least substantially perpendicular to a front panel 24 located in front of the user interface electrical module 25 and the handle 29 and at least substantially perpendicular to a front surface 201 of the door 2. In this embodiment, the cover portion 292 is substantially plate-like.

The grip portion 291 has a front surface parallel to the front panel 24. Thus, the handle 29 has a substantially L-shaped cross section.

The front panel 24 covers the user interface electrical module 25 and the grip portion 291. In the embodiment of the present invention, the front surface of the grip portion 291 is adjacent to the front panel 24 but maintains a tiny gap with the rear surface of the front panel 24, for example, it is adjacent to the front panel 24 with a gap between the grip portion 291 and the front panel 24 in a fore-and-aft direction not less than 0.2 mm but not greater than 1 mm. Preferably, the gap between the front surface of the grip portion 291 and the front panel 24 is between 0.2 mm and 0.6 mm, for example, the gap is 0.6 mm.

The handle 29 may further include a metal reinforcer 293, especially for reinforcing strength of the grip portion 291. The reinforcer 293 may almost extend along the whole length of the grip portion 291, which thus helps to prevent the technical problem that the user interface electrical module 25 and the front panel 24 are in poor contact caused by a force applied to the front panel 24 by transverse deformation of the grip portion 291 in a process of opening the door.

The handle 29 is fixed to the user interface housing 23. The user interface housing 23 has a plurality of installation walls, the installation walls are located between the first receiving space 231 and the handle groove 232 in a depth direction of the handle groove 232, and the handle 29 is fixed to the installation walls. In this embodiment, each installation wall is formed by a corresponding first boss wall 2391.

Each first boss wall 2391 is located on one corresponding side of the inlet of the first receiving space 231, and the handle 29 is fixed to the user interface housing 23 on two sides of the inlet of the first receiving space 231.

The door 2 includes a fixing member 30 for fixing the handle 29 to the user interface housing 23, and the fixing member 30, along the transverse direction of the door 2 (in this embodiment, also the depth direction of the handle groove 232), passes through a first hole 295 located on the handle 29 and a second hole 2393 located on the first boss wall 2391 to fix the handle 29 and the first boss wall 2931. The fixing member 30 can be removed from the door 2 without damaging the door 2, so as to overhaul the user interface electrical module 25 if necessary. The fixing member 30 preferably includes screws.

In this embodiment, the first hole 295 is disposed on the cover portion 292, and the cover portion 292 is fixed onto the first boss wall 2391.

The door 2 may include a reinforcing plate (not shown) connected to one side of the first boss wall 2391 facing the heat insulating layer 27, and the fixing member 30 is connected with the reinforcing plate, for example, the fixing member 30 is threaded to the reinforcing plate.

The user interface housing 23 includes a support portion supporting a front portion on one side of the cover portion 292 which side is away from the handle groove 232.

Specifically, the bosses 2381 and 2382 have a plurality of protruding walls 50 on the top thereof, the protruding walls 50 protrude forward from the top of the bosses 2381 and 2382, and one end thereof towards the second receiving space 237 is supporting a front end of one side of the cover portion 292 which side is away from the handle groove 232.

In this embodiment, one end of the protruding walls 50 towards the second receiving space 237 and the first boss wall 2391 are basically located in the same plane, and one side of the cover portion 292 away from the handle groove 232 is supported by the user interface housing 23 on the whole width thereof.

As the front end of one side of the cover portion 292 away from the handle groove 232 is supported by a support portion formed by the protruding walls 50, this can prevent the handle 29 from turning over towards the direction of the first receiving space 231 when the user's hand grips the grip portion 291 to open the door.

Figure 6:
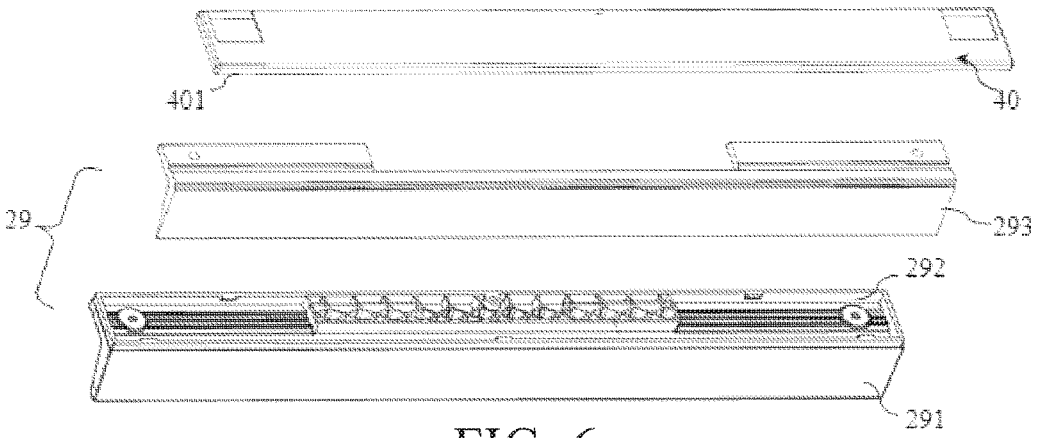
FIG. 6 is a schematic exploded view of a handle and a seal according to one preferred embodiment of the present invention.

As shown in FIG. 6 and FIG. 7, the door 2 may further include a seal 40, and the seal 40 includes annular sealing portions 401 disposed around four sides of the cover portion 292. The seal portions 401 are located between the front panel 24 and the handle 29, between the first rear wall 2331 and the handle 29, and between the upper and lower end walls 138*a* and 138*b* and the handle 29, so that possibility can be reduced that water vapor, dust and the like enter into the first receiving space 231.

Various embodiments of single parts described in combination with FIG. 1 to FIG. 7 can be combined in any given manner, to implement advantages of the present invention. In addition, the present invention is not limited to the illustrated embodiments, and generally, other means other than the illustrated means may also be used, as long as the means may also achieve the same effect.

What is claimed is:

1. A refrigerator door, comprising:

a door liner;

a front wall including a metal sheet;

a user interface housing connected to said front wall, said user interface housing having a first receiving space and a second receiving space configured to be in communication with each other;

a handle groove disposed in said second receiving space and defining a depth direction of said handle groove;

said user interface housing having at least one installation wall disposed between said first receiving space and said handle groove in said depth direction of said handle groove, said first receiving space located on one side of said installation wall and all of said handle groove located on an opposite side of said installation wall;

a heat insulating layer, said user interface housing, said door liner and said front wall being fixedly connected to said heat insulating layer;

a user interface electrical module to be inserted through said second receiving space into said first receiving space; and a handle detachably received in said second receiving space, said handle including a cover portion separating said first receiving space from all of said handle groove, said handle having a grip portion disposed in said second receiving space and said handle being fixed to said installation wall;

said grip portion of said handle supported by said cover portion of said handle; and said handle being removable to open a lateral communication pathway between said first receiving space and said handle groove in a region located directly behind said metal sheet of said front wall.

2. The refrigerator door according to claim 1, wherein said door includes a fixing member for fixing said handle to said user interface housing, said fixing member passing through a through hole in said handle and being connected to said installation wall.

3. The refrigerator door according to claim 2, wherein said fixing member passes through said handle and said installation wall along said depth direction of said handle groove.

4. The refrigerator door according to claim 1, wherein said cover portion is fixed to said installation wall.

5. The refrigerator door according to claim 4, wherein said door has a front surface, and said cover portion is at least substantially perpendicular to said front surface of said door.

6. The refrigerator door according to claim 4, wherein said cover portion has a side facing away from said handle groove, said side has a front portion, and said user interface housing includes a support portion supporting said front portion of said side of said cover portion facing away from said handle groove.

7. The refrigerator door according to claim 4, wherein said cover portion has a side facing away from said handle groove, and said user interface housing supports said side of said cover portion facing away from said handle groove along an entire width of said cover portion.

8. The refrigerator door according to claim 6, wherein said support portion is formed by a part of said installation wall.

9. The refrigerator door according to claim 1, wherein said first receiving space has an inlet with sides, said installation wall of said user interface housing is one of at least a pair of installation walls, and said pair of installation walls are each disposed at a respective one of said sides of said inlet of said first receiving space.

10. The refrigerator door according to claim 1, wherein said user interface housing includes a boss adjacent said first receiving space, and said installation wall is formed by said boss.

11. The refrigerator door according to claim 10, wherein said handle has a side facing said installation wall, said side has a front portion, said user interface housing includes a plurality of protruding walls protruding forward from said boss, and said protruding walls form a support portion supporting said front portion of said side of said handle facing said installation wall.

12. The refrigerator door according to claim 10, wherein said front wall has an opening, said user interface housing is connected to said front wall along said opening, said first receiving space and said second receiving space are open towards said opening, and said boss is exposed to said opening.

13. The refrigerator door according to claim 1, wherein said door includes a front panel covering said user interface electrical module and said grip portion.

14. The refrigerator door according to claim 13, wherein said grip portion has a front surface, said user interface electrical module is in contact with said front panel, a gap is formed between said front surface of said grip portion and said front panel, and said gap is not less than 0.2 mm and not greater than 1 mm.

15. The refrigerator door according to claim 13, wherein said grip portion has a front surface, said user interface electrical module is in contact with said front panel, a gap is formed between said front surface of said grip portion and said front panel, and said gap is between 0.2 mm and 0.6 mm.

16. The refrigerator door according to claim 1, wherein said second receiving space includes a concave portion being open in a forward direction, and said handle groove is accessible through said concave portion when said handle is detachably received in said second receiving space to close the lateral communication pathway between said first receiving space and said handle groove.

17. The refrigerator door according to claim 1, wherein said handle groove perpendicularly extends away from said front panel to a greater extent than said first receiving space.

* * * * *